US009599091B2

(12) United States Patent
Rigolon et al.

(10) Patent No.: US 9,599,091 B2
(45) Date of Patent: Mar. 21, 2017

(54) HYDRAULIC ACTUATION UNIT, PARTICULARLY FOR CONTROLLING THE STARTING AND STOPPING OF HYDRAULIC MOTORS

(71) Applicant: POCLAIN HYDRAULICS INDUSTRIALE S.R.L., Castelfranco, Emilia (IT)

(72) Inventors: Enrico Rigolon, Modena (IT); Enzo Corradini, Modena (IT)

(73) Assignee: POCLAIN HYDRAULICS INDUSTRIALE S.R.L., Castelfranco Emilia (IT)

( * ) Notice: Subject to any disclaimer, the term of this patent is extended or adjusted under 35 U.S.C. 154(b) by 320 days.

(21) Appl. No.: 14/357,057

(22) PCT Filed: Nov. 8, 2012

(86) PCT No.: PCT/EP2012/072115
§ 371 (c)(1),
(2) Date: May 8, 2014

(87) PCT Pub. No.: WO2013/068449
PCT Pub. Date: May 16, 2013

(65) Prior Publication Data

US 2014/0290475 A1 Oct. 2, 2014

(30) Foreign Application Priority Data

Nov. 9, 2011 (EP) ..... 11425269

(51) Int. Cl.
*F15B 11/044* (2006.01)
*F03C 1/03* (2006.01)
(Continued)

(52) U.S. Cl.
CPC ..... *F03C 1/03* (2013.01); *F03C 1/003* (2013.01); *F03C 1/045* (2013.01); *F03C 1/0681* (2013.01);
(Continued)

(58) Field of Classification Search
CPC ..... F15B 11/0445; F15B 2211/715
See application file for complete search history.

(56) References Cited

U.S. PATENT DOCUMENTS 4,244,276 A * 1/1981 Iwata ..... E02F 9/226 303/11
6,539,712 B2 * 4/2003 Konishi ..... F15B 11/0445 60/460
2011/0094280 A1 4/2011 Jamet

FOREIGN PATENT DOCUMENTS

CN 101111665 A 1/2008
CN 102089529 A 6/2011
(Continued)

OTHER PUBLICATIONS

European Search Report from corresponding Euorpean Application No. EP 11425269 dated Sep. 20, 2012.
(Continued)

*Primary Examiner* — F. Daniel Lopez
(74) *Attorney, Agent, or Firm* — Lando & Anastasi, LLP

(57) ABSTRACT

A hydraulic actuation unit for controlling the starting and stopping of hydraulic motors includes a first main circuit and a second main circuit, a first recirculation circuit and a second recirculation circuit, a counterbalancing valve, which includes a shuttle, and a first discharge channel and a second discharge channel. The shuttle includes a first check valve and a second check valve. The first check valve includes at least one first flow control element that can move from an open position to a closure position. The second check valve includes at least one second flow control
(Continued)

element that can move from an open position to a closure position. The first and second check valves respectively are provided with first damping means and second damping means in order to slow down the passage movement respectively of the first flow control element and of the second flow control element.

11 Claims, 8 Drawing Sheets

(51) Int. Cl.
*F03C 1/40* (2006.01)
*F03C 1/00* (2006.01)

(52) U.S. Cl.
CPC ..... *F03C 1/0684* (2013.01); *F15B 11/0445* (2013.01)

(56) References Cited

FOREIGN PATENT DOCUMENTS

| | | | |
|---|---|---|---|
| FR | 2 891 593 | A1 | 4/2007 |
| FR | 2 940 672 | A1 | 7/2010 |
| GB | 2 278 890 | A | 12/1994 |
| WO | 2006081829 | A1 | 8/2006 |

OTHER PUBLICATIONS

International Search Report and Written Opinion from corresponding PCT/EP2012/072115 mailed Jul. 26, 2013.

* cited by examiner

HYDRAULIC ACTUATION UNIT, PARTICULARLY FOR CONTROLLING THE STARTING AND STOPPING OF HYDRAULIC MOTORS

This application is the U.S. National Phase Application under 35 U.S.C. §371 of International Application No. PCT/EP2012/072115, filed Nov. 8, 2012, which claims priority to European Patent Application No. 11425269.5 filed Nov. 9, 2011. These prior applications are incorporated by reference herein in their entirety.

The present invention relates to a hydraulic actuation unit, particularly for controlling the starting and stopping of hydraulic motors.

Hydraulic circuits for supplying hydraulic motors are known which can be actuated with a rotary motion in both directions of rotation. These types of motor are provided with intake ports and discharge ports, the function of which can be reversed, so as to obtain the rotation of the motor in one direction or in the opposite direction.

These circuits generally comprise a first main circuit, which can connect the intake/discharge port of the hydraulic motor to a supply of a working liquid, usually oil, under high pressure, or to a low-pressure relief tank, and a second main circuit that can connect the intake/discharge port to a low-pressure relief tank or to a supply of a high-pressure working liquid.

Conveniently, reversing the connection of the main circuits to the high-pressure supply or to the relief tank leads to the reversal of the oil flow inside the hydraulic motor and consequently to the reversal of the rotation direction of the motor.

Such operation is normally performed by means of a slide valve, accommodated in conventional hydraulic units, which is interposed between an initial portion and an end portion of the first main circuit and of the second main circuit. This slide valve, by switching from a first end position to a second end position, makes it possible to reverse the oil flow and ensures its correct direction of circulation described above. The slide valve can also assume a third position, usually intermediate between the two end positions, in order to actuate the interruption of the flow of oil in the two main circuits in order to stop the rotation of the hydraulic motor.

In the transient that occurs when the slide valve passes from one of the two end positions, in which the supply and the discharge of the oil to the motor is ensured, to the third position, in which the flow of oil to the motor is blocked, cavitation may occur inside the motor because the motor, by inertia, continues its rotation, acting as a pump and making the oil pressure decrease.

Thanks to this solution, the stopping motor has part of the oil inside it at high pressure and part of the oil, drawn in the transient, at low pressure. The presence of oil at different pressures, besides not avoiding completely the possibility of cavitation, creates an uneven rotation of the motor while stopped, i.e., an intermittent rotation, an effect which is more conspicuous on small hydraulically driven machines because the inertial mass that opposes the force is minimum.

In order to obviate this drawback, hydraulic units are used which draw high-pressure oil directly from the main circuit connected to the high-pressure supply. This withdrawal is placed in recirculation in the motor during stopping only from the intake port to the discharge port by means of a bypass circuit. The bypass circuit is composed of a main channel into which the high-pressure oil flows away in order to then gather at the intake port of the motor, passing through at least one check valve which ensures, with its opening in only one direction, the recirculation of the oil in the desired direction.

Conventional hydraulic units are not free from drawbacks, including the fact that the stopping rotation of the motor is still partly not smooth and not continuous. This intermittent rotation is due to the presence of the check valves, commonly also known as maximum pressure valves, which allow their opening, and the consequent recirculation flow, when the difference in oil pressure upstream and downstream of the valve is sufficient to overcome the force of the spring that tends to close the flow control element of the valve.

Once the valve has been opened, the pressure difference between upstream and downstream tends to level out, causing the valve to close again. The motor, with less and less inertia, continues to turn, increasing the oil pressure in output and opening the valve again, repeating the cycle described above until the motor stops completely. The alternating opening and closing of the valve establishes an almost cyclic damped force.

Another drawback of conventional hydraulic units resides in that they have short damping times, because the presence of the check valves in the recirculation circuit allows the passage of the oil only if the difference in pressure at the two ends of the valve is sufficient to overcome the force of the spring, and at each opening of the valve the oil takes a certain stagnation time, albeit a minimum one, in order to be able to reach the pressure required to open the valve.

A further drawback of conventional hydraulic units resides in that they require rather large volumes, because the hydraulic unit must accommodate inside it also at least the two check valves or similar hydraulic components.

Another drawback of conventional hydraulic units resides in that they allow only a sudden start of the hydraulic motor, because the supply to the motor following the start command is immediate, without any gradual starting transient.

This drawback is worsened in hydraulically driven machines of reduced size with minimal inertial mass, such as for example small excavators. In such machines, cyclic movement in opposite directions of travel is very frequent and the forces just described, caused by the starting and stopping of the motor, affect entirely the operator, who, sitting in a limited space, is subjected to continuous alternated stresses of the trunk toward the back of the seat and toward the front protective glass, risking at each start and stop of the motor a collision against them.

The aim of the present invention is to provide a hydraulic actuation unit, particularly for controlling the starting and stopping of hydraulic motors, that solves the problems and overcomes the limitations of the background art, allowing a soft start of the hydraulic motor.

Within this aim, an object of the present invention is to provide a hydraulic unit that allows a soft stop of the hydraulic motor.

Another object of the invention is to provide a compact hydraulic unit of reduced size if compared with the size of conventional hydraulic units.

A further object of the invention is to provide a hydraulic unit that is capable of giving the greatest assurances of reliability and safety in use.

Yet another object of the invention is to provide a unit that is easy to provide and economically competitive.

This aim and these objects, as well as others that will become better apparent hereinafter, are achieved by a hydraulic actuation unit, particularly for controlling the starting and stopping of hydraulic motors, comprising:

a first main circuit and a second main circuit, which are adapted to connect selectively a supply of pressurized working liquid and a tank to a hydraulic motor;

a first recirculation circuit and a second recirculation circuit for returning respectively a fraction of said working liquid from said second main circuit to said first main circuit and vice versa;

a counterbalancing valve, which comprises a shuttle that can switch to a first end position and a second end position, which correspond to the actuation of said motor with mutually opposite directions of rotation, and comprises a first passage channel and a second passage channel, which are arranged respectively along said first main circuit and along said second main circuit; said shuttle comprising a first check valve and a second check valve respectively arranged in said first passage channel and in said second passage channel, said first check valve comprising at least one first flow control element that can move from an open position, for the passage of said working liquid along said first passage channel and therefore along said first main circuit, to a closure position, for closing said first passage channel and therefore said first main circuit and vice versa, said second check valve comprising at least one second flow control element that can move from an open position for the passage of said working liquid along said second passage channel and therefore along said second main circuit to a closure position for the closure of said second passage channel and therefore of said second main circuit and vice versa;

a first discharge channel and a second discharge channel, for the connection respectively of said first main circuit to said second recirculation circuit and of said second main circuit to said first recirculation circuit;

characterized in that said first check valve and said second check valve respectively have first damping means and second damping means in order to slow down the passage movement respectively of said first flow control element and of said second flow control element from the respective closure position to the respective open position.

Further characteristics and advantages of the invention will become better apparent from the description of a preferred but not exclusive embodiment of a hydraulic actuation unit according to the invention, illustrated by way of non-limiting example with the aid of the accompanying drawings, wherein.

Figure 1:
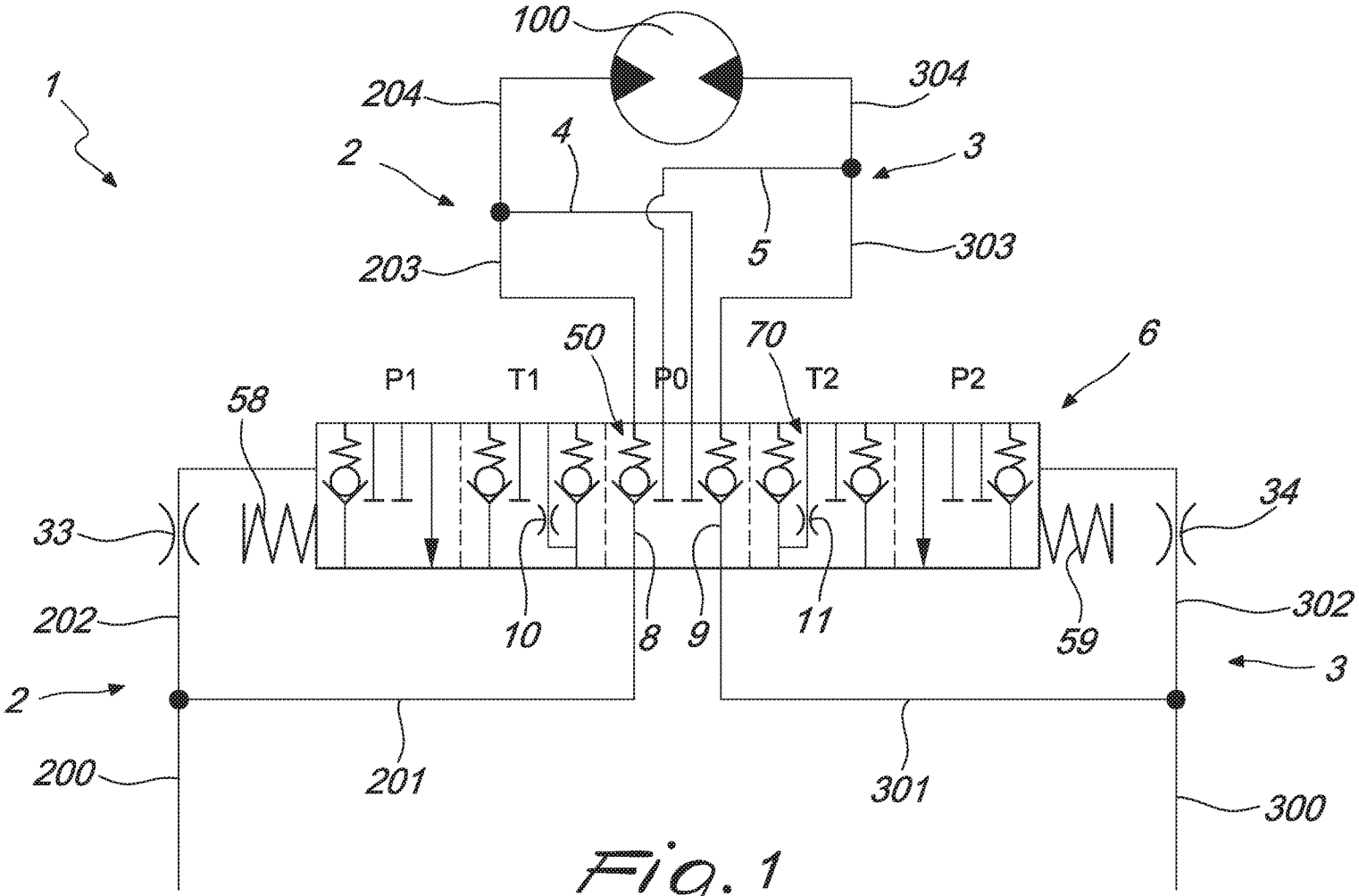
FIG. 1 is a schematic view of the hydraulic circuit of a hydraulic actuation unit according to the invention.

With reference to the figures, a hydraulic actuation unit, generally designated by the reference numeral 1, comprises a first main circuit 2 and a second main circuit 3, which are adapted to connect selectively a supply of a pressurized working liquid and a tank to respective intake ports and discharge ports of a hydraulic motor 100 for its actuation.

Moreover, the hydraulic unit 1 comprises a first recirculation circuit 4 and a second recirculation circuit 5 for the return respectively of a fraction of the working liquid from the second main circuit 3 to the first main circuit 2 and vice versa.

The reversal of the connection of the first main circuit 2 from the supply of a pressurized working liquid to the tank and at the same time the reversal of the connection of the second main circuit 3 from the tank to the supply of a pressurized working liquid causes the reversal of the direction of rotation of the motor 100. The reversal is allowed by means of the switching to a first end position P1 and a second end position P2 of a shuttle 7 of a counterbalancing valve 6 accommodated inside the hydraulic unit 1.

The shuttle 7 comprises a first passage channel 8 and a second passage channel 9, which are arranged respectively along the first main circuit 2 and along the second main circuit 3. The shuttle 7 comprises, moreover, a first check valve 50 and a second check valve 70, arranged respectively in the first passage channel 8 and in the second passage channel 9.

In particular, the first check valve 50 comprises at least one first flow control element 51 that can move from an open position, in which it allows the passage of the working liquid along the first passage channel 8 and therefore into the first main circuit 2, to a closure position, in which it interrupts the passage of the working liquid along the passage channel 8, and therefore into the first main circuit 2, as instead occurs in the open position, and vice versa. At the same time, the second check valve 70 also comprises at least one second flow control element 71, which can move from an open position, in which it allows the passage of the working liquid along the second passage channel 9 and therefore into the second main circuit 3, to a closure position, in which it interrupts the passage of the working liquid along the second passage channel 9, and therefore in the second main circuit 3, as instead occurs in the open position, and vice versa.

The hydraulic unit 1 also comprises a first discharge channel 10 for the connection of the first main circuit 2 to the second recirculation circuit 5 and a second discharge channel 11 for the connection of the second main circuit 3 to the first recirculation circuit 4.

According to the invention, the first check valve 50 and the second check valve 70 respectively are provided with first damping means 52 and second damping means 72 in order to slow the passage movement respectively of the first flow control element 51 and of the second flow control element 71 from the respective closure position to the respective open position.

More particularly, the first damping means 52 comprise a first stem 56 of the first flow control element 51 which is slidingly and hermetically associated within a first filling chamber 55 defined in the first check valve 50 to vary the internal volume of the first filling chamber 55 when the first flow control element 51 moves from the closure position to the open position and vice versa. Moreover, the first stem 56 has a first hole 54 for the calibrated passage of the working liquid from the first filling chamber 55 outward during the movement of the first flow control element 51 from the closure position to the open position and, in the opposite direction, for the calibrated passage of the working liquid toward the first filling chamber 55 during the movement of the first flow control element 51 from the open position to the closure position.

At the same time, the damping means 72 also comprise a respective second stem 76 which is associated slidingly and hermetically within a respective second filling chamber 75, the internal volume of which varies due to the movement of the second flow control element 71 in the manner described for the first damping means 52, by expelling or introducing in the second filling chamber 75 the excess or lacking working liquid through a second hole 74.

Conveniently, all the described circuits and channels, as well as a sliding seat 12 of the shuttle 7, are defined in a main body 13 of the hydraulic unit 1.

The substantially cylindrical sliding seat 12 accommodates hermetically, so that it can slide axially along the longitudinal axis 14 of the the seat 12, the shuttle 7 for the connection of the circuits, which communicate with the sliding seat 12, by means of the channels defined in the shuttle 7.

More particularly, the sliding seat 12 is provided with a first central plane 21 ideally arranged at the center of the sliding seat 12 and at right angles to the longitudinal axis 14, from which a first chamber 15 and a second chamber 16 are equidistant, on mutually opposite sides, and communicate respectively with the first main circuit 2 and the second main circuit 3, which in turn are connected directly to the motor 100. Between the first chamber 15 and the first central plane 21, on the sliding seat 12, a third chamber 17 is provided, which is connected, by means of the second recirculation channel 5, to a sixth chamber 20 arranged between the second chamber 16 and an axial end of the sliding seat 12. Symmetrically with respect to the first central plane 21, between the second chamber 16 and the first central plane 21, a fourth chamber 18 is provided, which is connected, by means of the first recirculation channel 4, to a fifth chamber 19 arranged between the first chamber 15 and the other axial end of the sliding seat 12.

Moreover, the third chamber 17 and the fourth chamber 18 are connected to a first initial portion 201 of the first main circuit 2 and to a second initial portion 301 of the second main circuit 3, alternately, according to the direction of rotation of the motor 100, connected to a pressurized supply or to the tank of the hydraulic circuit.

The chambers 15, 16, 17, 18, 19 and 20 allow the passage of the working liquid from one to the other by means of a series of ports provided in the side wall or of channels provided inside the shuttle 7.

The shuttle 7, which can move axially on command along the longitudinal axis 14 with respect to the sliding seat 12, can be arranged mainly in a first end position P1 and in a second end position P2 for the actuation of the motor 100 with mutually opposite directions of rotation and in a third intermediate position P0, between the first two end positions P1 and P2, in order to stop the motor 100.

The shuttle 7 has a second central plane 22, at right angles to the longitudinal axis 14, which divides ideally the shuttle 7 into two mutually mirror-symmetrical parts. The first passage channel 8, defined inside the shuttle 7, is connected to the third chamber 17 and to the first chamber 15 respectively through a first port 23 and through a third port 25. Symmetrically with respect to the second central plane 22, the second passage channel 9 also is connected to the fourth chamber 18 and to the second chamber 16 respectively through a second port 24 and through a fourth port 26.

Finally, the first discharge channel 10 and the second discharge channel 11 comprise, respectively, a first groove 53 and a second groove 73 defined circumferentially on the side wall of the shuttle 7. The first groove 53 is arranged proximate to the first chamber 15, which is connected to the first main circuit 2, while the second groove 73 is arranged proximate to the second chamber 16, which is connected to the second main circuit 3.

In the transitional positions of the shuttle 7, during the passage from one of the two end positions P1 or P2 to the intermediate position P0, the first groove 53 and the second groove 73 alternately connect respectively the first chamber 15 to the fifth chamber 19 or the second chamber 16 to the sixth chamber 20. The first groove 53 and the second groove 73 furthermore are provided with a cross-section that increases toward the second central plane 22.

In this particular embodiment, the grooves 53 and 73 are provided with a series of steps that increase their depth as one proceeds toward the second central plane 22, i.e., respectively toward the first chamber 15, which is connected to the first main circuit 2, and toward the second chamber 16, which is connected to the second main circuit 3.

Laterally to the grooves 53 and 73, on the side wall of the shuttle 7, a first shoulder 57 and a second shoulder 77 are provided, against which a first helical pusher spring 58 and a second spring 78, identical to the preceding one, are respectively engaged. The two springs 58 and 78, in the absence of pressurized liquid, hold the shuttle 7 in the intermediate position P0, making the first central plane 21 coincide with the second central plane 22.

In the illustrated embodiment, the two springs 58 and 78 apply their elastic force to the two shoulders 57 and 77 engaging with their respective opposite ends against a respective plug 27 connected to the main body 13 by means of a screw-and-nut coupling and against a respective shim ring 28 interposed between the respective spring 58 or 78 and the shoulders 57 or 77.

Figure 2:
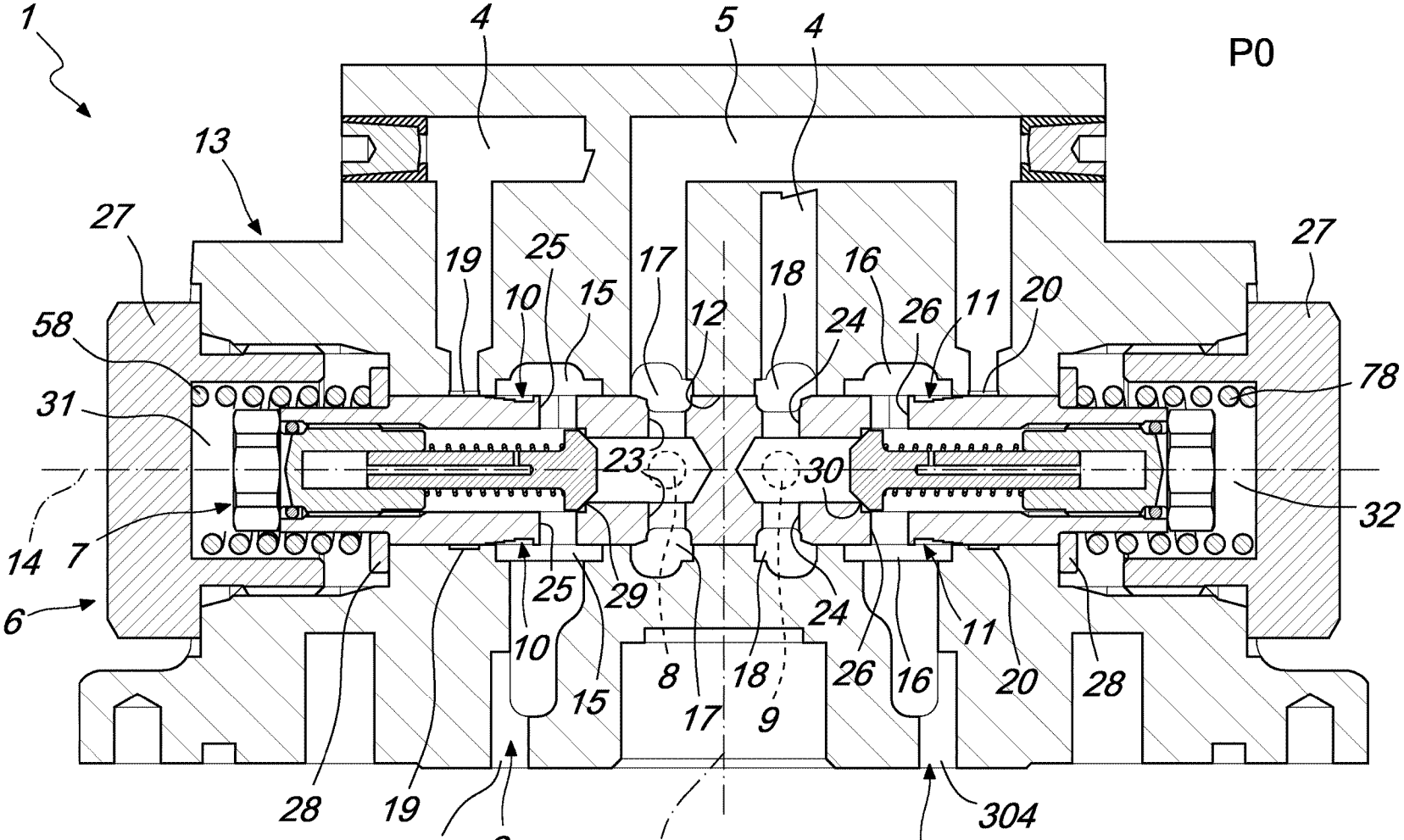
FIG. 2 is an axial sectional view of a hydraulic unit according to the invention, taken along a first transverse plane that passes through the recirculation circuits and the counterbalancing valve with the shuttle in an intermediate position.

In particular, the distance between the two shoulders 57 and 77 is identical to the length of the sliding seat 12. This allows the two springs 58 and 78 to not apply any pushing action to the shuttle 7 when such shuttle is in the intermediate position P0, since the shim rings 28 abut against the lateral ends of the sliding seat 12, as shown in FIG. 2.

Proximate to the plugs 27, i.e., at the opposite ends of the shuttle 7, the check valves 50 and 70 are provided.

More specifically, the first check valve 50 comprises a first base body 59, which is associated with an end of the shuttle 7 by means of a screw-and-nut coupling and has, on a first face 60, a first cylindrical dead hole 61 with an axis that coincides with the longitudinal axis 14. The first stem 56, which also is cylindrical with a circular cross-section and with an axis that coincides with the longitudinal axis 14, is coupled slidingly inside the hole 61. The play between the outside diameter of the stem 56 and the inside diameter of the hole 61 is such to allow sliding between the two elements, but not allow the seepage of the liquid, ensuring a substantially hermetic sliding between the two elements.

A first substantially frustum-like head 62 is present at the end of the stem 56 that is opposite with respect to the end inserted in the hole 61 and is arranged in contact, with a radial seal, with a first sealing end 29 of the first passage channel 8 in order to block the flow from the third port 25 to the second port 23. The first flow control element 51 is kept in contact with the end 29 thanks to the presence of a first contrast spring 63 interposed between the flat base of the head 62 and the first face 60.

Moreover, the first flow control element 51 has, inside it, the first hole 54, which is composed of a first portion 64 and a second portion 65 that are connected to each other. In particular, the first portion 64 is constituted by a dead hole whose axis coincides with the longitudinal axis 14 formed starting from the end of the stem 56 that is internal to the first cylindrical dead hole 61, while the second portion 65 is constituted by a hole, which is substantially perpendicular to the longitudinal axis 14 and leads outside, that is arranged proximate to the first head 62 so that it cannot be blocked during the sliding of the first flow control element 51.

Identically to the first check valve 50, the second check valve 70 also has the same elements functionally arranged with respect to each other as just described, i.e., a second base body 79 that is accommodated at one end of the shuttle 7 and has, on a first face 80, a second cylindrical dead hole 81 whose axis coincides with the longitudinal axis 14. The second cylindrical dead hole 81 accommodates the second stem 76 with sufficient play to ensure the sliding and the hydraulic seal between the two elements. Furthermore, the second stem 76 has a second head 82 that is kept in contact with a second end 30 of the second passage channel 9 to prevent the passage of the liquid from the fourth port 26 to the second port 24. Moreover, the second stem 76 comprises a third portion 84 and a fourth portion 85 that form the second hole 74.

The first main circuit 2 and the second main circuit 3 are divided into different portions upstream and downstream of the counterbalancing valve 6. In particular, the first main circuit 2 has a first main portion 200 which is connected to the pressurized supply or to the discharge tank, branching subsequently into a first initial portion 201 and a first control portion 202, both of which are connected directly to the counterbalancing valve 6. Downstream of the counterbalancing valve 6, the first main circuit 2 has a first end portion 203 that is connected directly to the counterbalancing valve 6 and a first end portion 204, which is connected to the first end portion 203 and which is connectable to the first recirculation circuit 4, where the first end portion 204 is connected directly to the motor 100. At the same time, the second main circuit 3 also has a second main portion 300 that is connected to the pressurized supply or to the discharge tank, branching subsequently into a second initial portion 301 and a second control portion 302, both of which are connected directly to the counterbalancing valve 6. Downstream of the counterbalancing valve 6, the second main circuit 3 has a second end portion 303 that is connected directly to the counterbalancing valve 6 and a second end portion 304, which is connected to the second end portion 303 and which is connectable to the second recirculation circuit 5, where the second end portion 304 is connected directly to the motor 100.

Finally, between the plugs 27 and the opposite ends of the shuttle 7, which in this embodiment correspond to the first base body 59 and to the second base body 79 of the respective valves 50 and 70, a third filling chamber 31 and a fourth filling chamber 32 are provided, which are connected respectively to the first control portion 202 and to the second control portion 302, along which a first choke 33 and a second choke 34 are arranged respectively.

Conveniently, the first initial portion 201 and the second initial portion 301 are connected respectively to the third chamber 17 and to the fourth chamber 18, while the first end portion 203 and the second end portion 303 are connected respectively to the first chamber 15 and to the second chamber 16.

Operation of the hydraulic actuation unit according to the invention is as follows.

Figure 5:
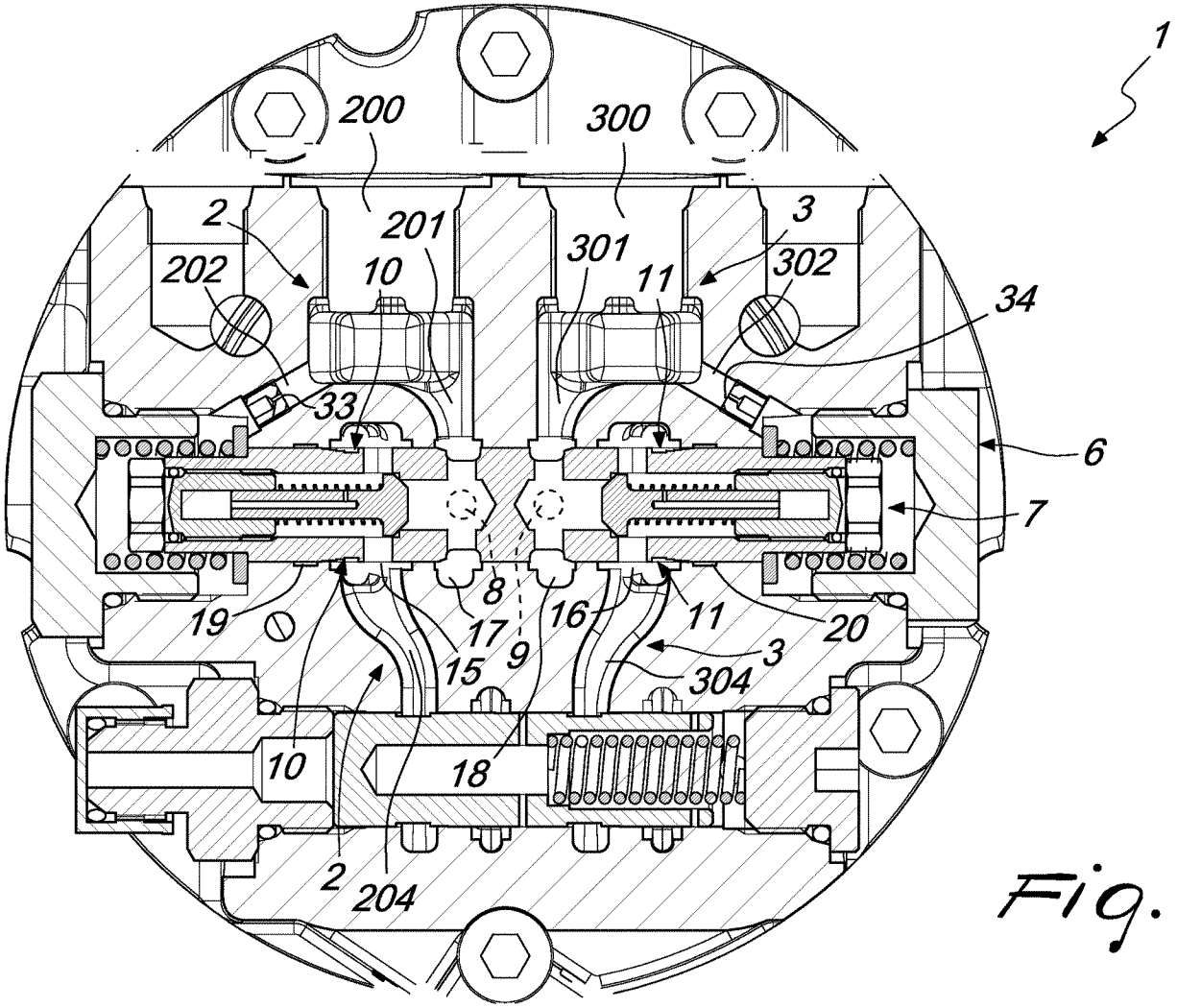
FIG. 5 is a further axial sectional view of the hydraulic unit according to the invention, taken along a transverse plane that passes through the counterbalancing valve with the shuttle in an intermediate position.
Figure 6:
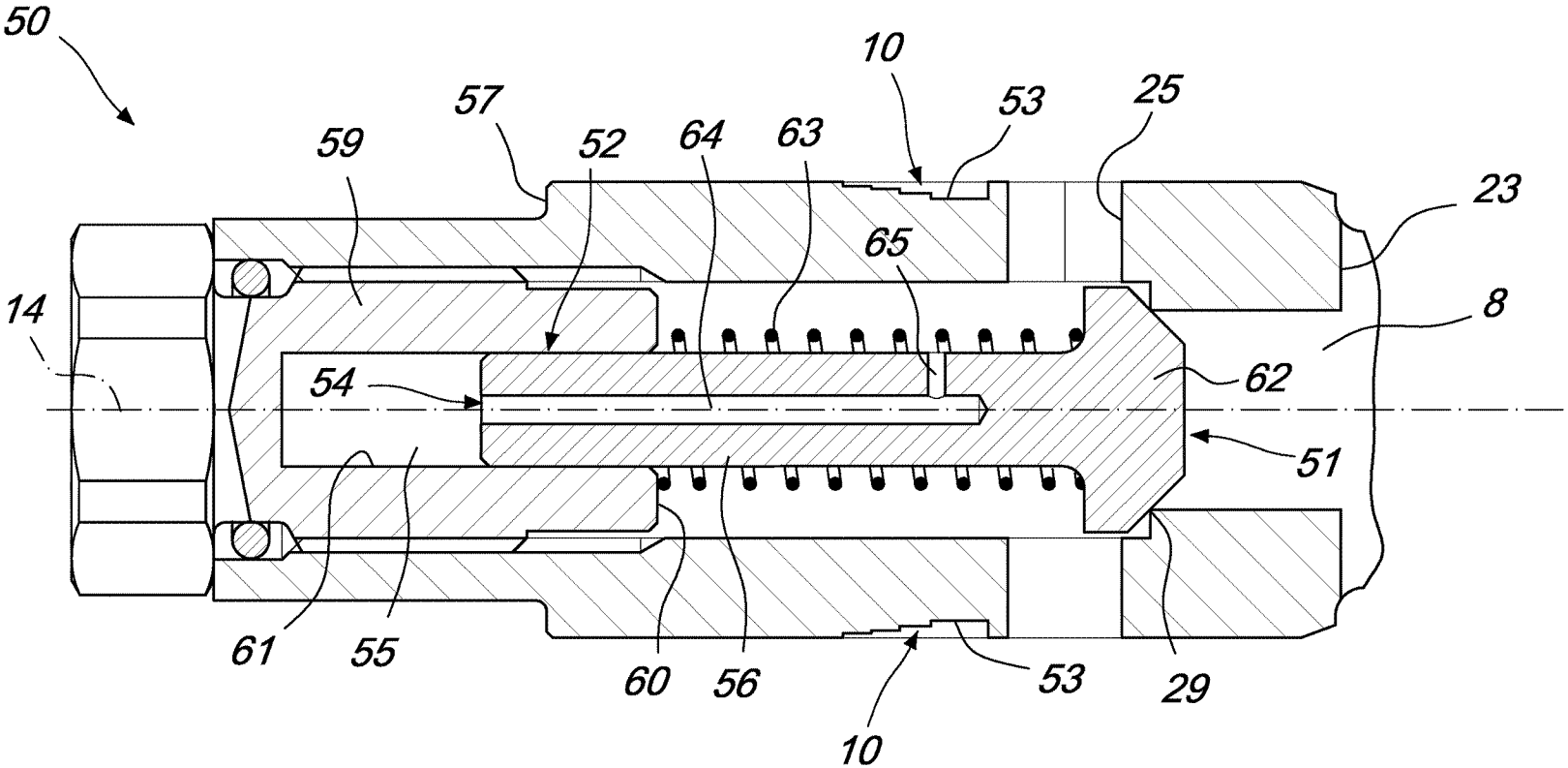
FIG. 6 is an enlarged-scale axial sectional view of a first check valve of the hydraulic unit shown in FIG. 2.
Figure 7:
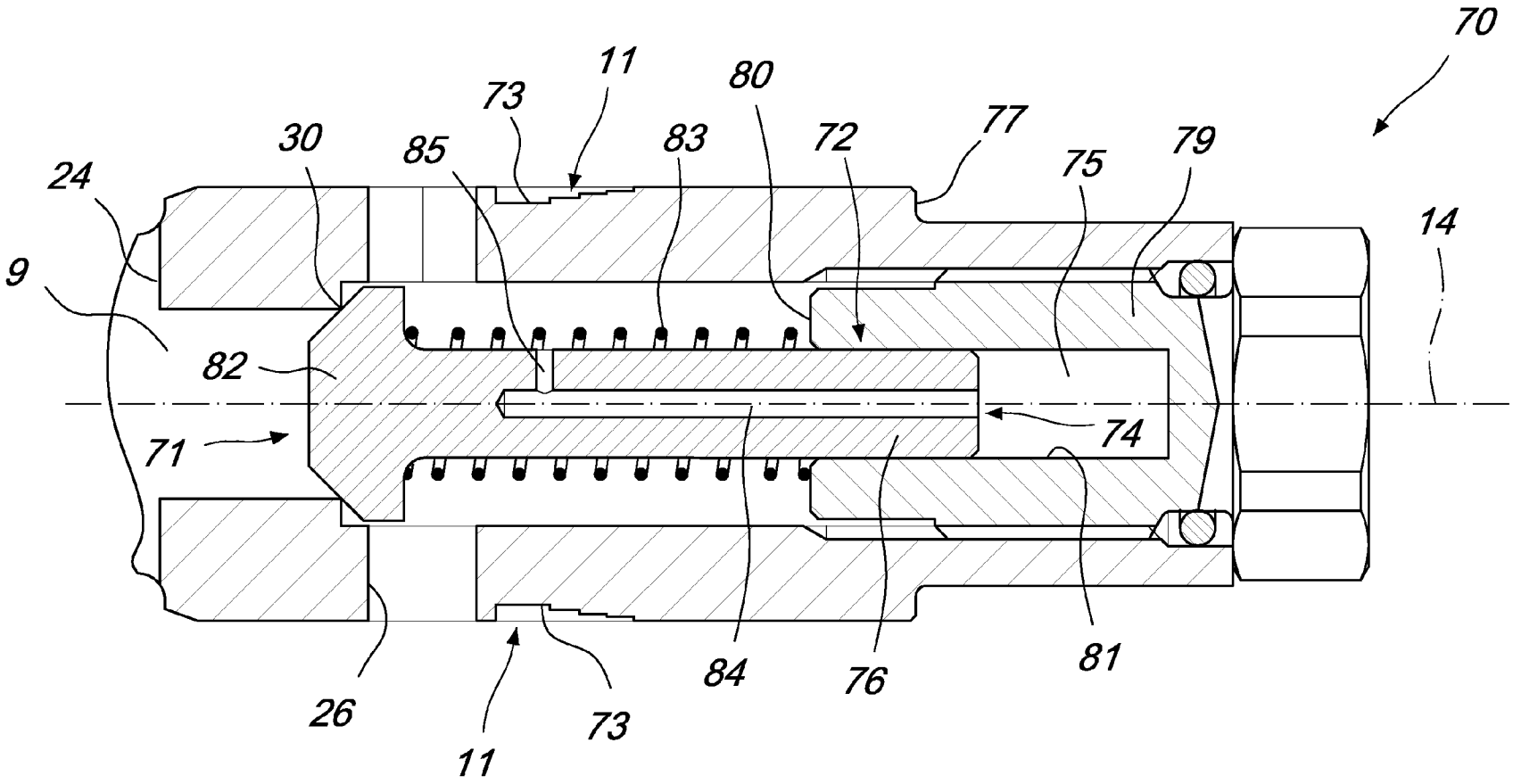
FIG. 7 is an enlarged-scale axial sectional view of a second check valve of the hydraulic unit shown in FIG. 2.

When the main circuits 2 and 3 are not connected to a supply of pressurized working liquid, the shuttle 7 is in the intermediate position P0, in which the first central plane 21 coincides with the second central plane 22 and consequently the motor 100 does not receive liquid from its intake port. Moreover, the first flow control element 51 and the second flow control element 71 are in the closure position, as shown in FIG. 1 and FIG. 5.

When the first main circuit 2 is connected to a supply of pressurized working liquid, the working liquid reaches the third chamber 17 and the first choke 33.

Figure 3:
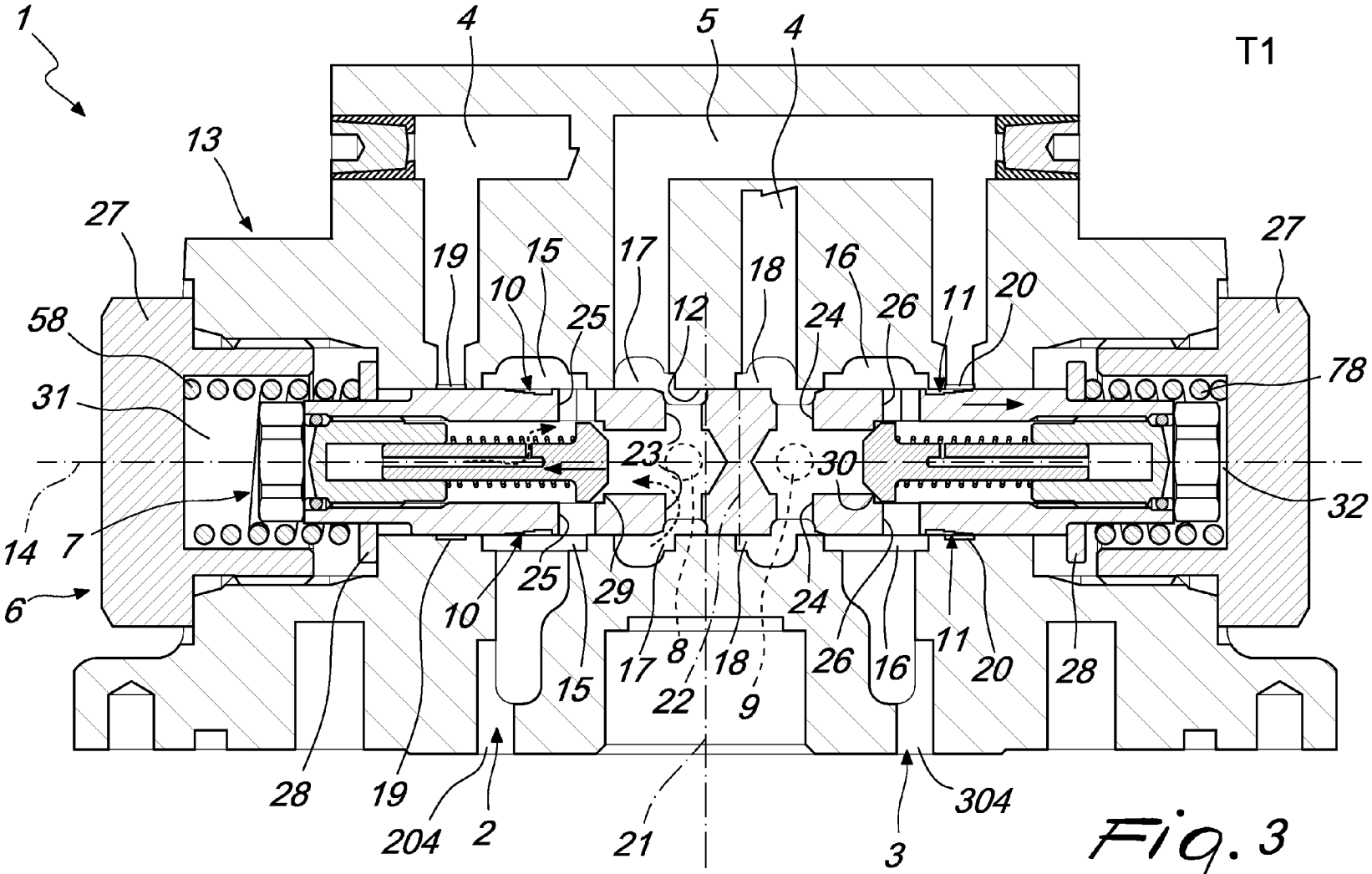
FIG. 3 is an axial sectional view of the hydraulic unit according to the invention, taken like FIG. 2 with the shuttle in a transient starting position.

The pressurized liquid, by means of the first choke 33, flows into the third filling chamber 31. Inside this last chamber, the pressure increases and, by acting on the surface of the first base body 59, pushes the shuttle 7 toward the end position P1, overcoming the elastic contrast force of the second spring 78, as shown in FIG. 3.

At the same time, the pressurized liquid, by passing from the third chamber 17, arrives in the first passage channel 8 by passing through the first port 23, where, because of the presence of the first head 62 sealed against the first sealing end 29, does not pass immediately toward the first chamber 15. Despite the presence of the pressurized liquid in the main circuit 2, the motor 100 is still motionless and the shuttle 7 is in a transient start position T1, as shown in FIG. 3.

The pressure of the liquid in the first passage channel 8 overcomes the elastic force of the first contrast spring 63, making the first flow control element 51 retract toward the first filling chamber 55, which is full of liquid, reducing its internal volume. The presence of oil in this chamber prevents the instantaneous opening of the first check valve 50, because the liquid trapped inside it flows outward exclusively through the first hole 54. The calibrated outflow of the liquid from the first filling chamber 55 thus allows a damped opening of the first check valve 50, making the first flow control element 51 switch from the closure position to the open position.

Once the first check valve 50 has been opened completely, the liquid, through the third port 23 and subsequently through the first chamber 15, flows out toward the first end portion 203 and then toward the first end portion 204, turning the motor 100.

Figure 4:
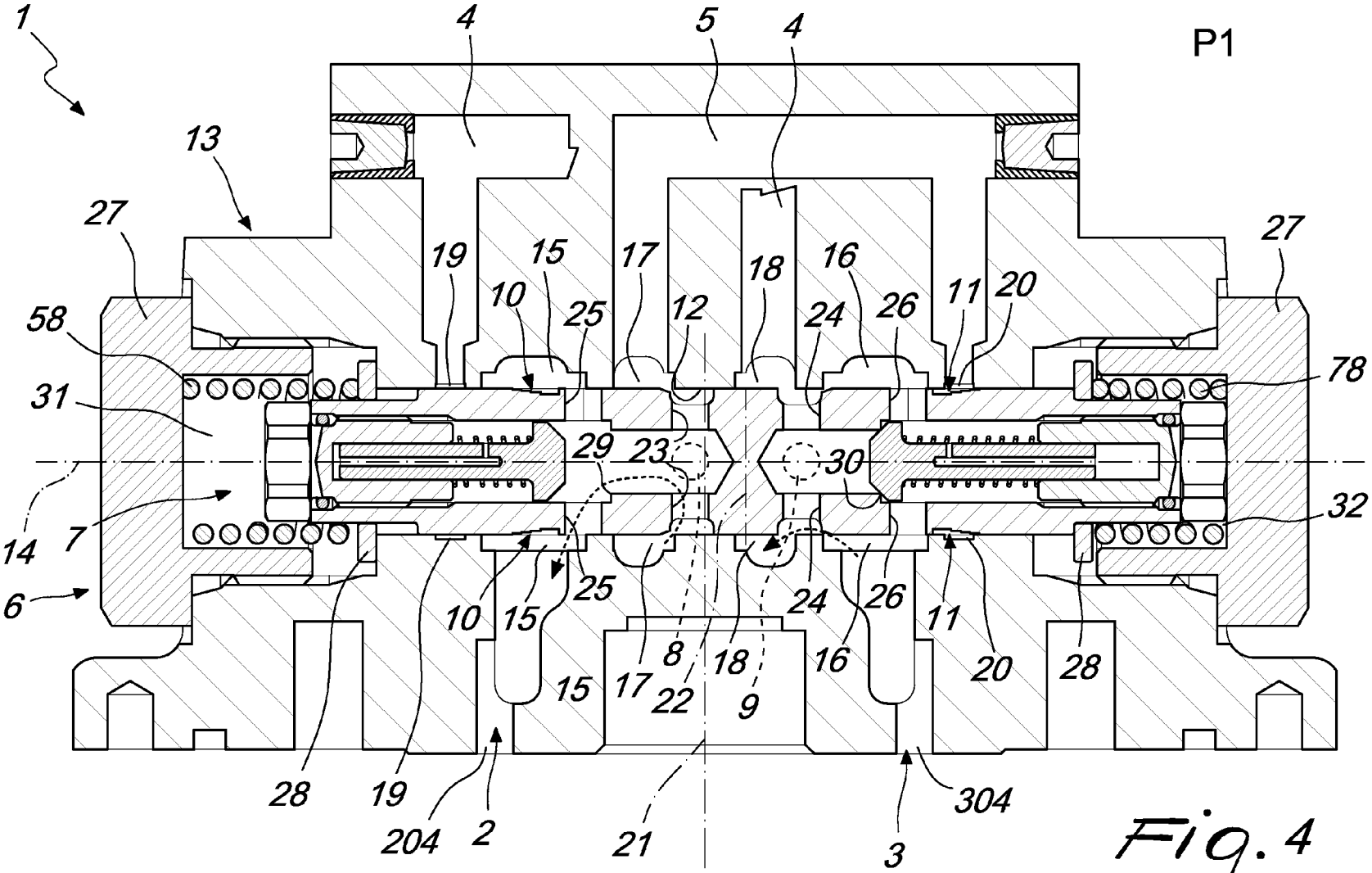
FIG. 4 is an axial sectional view of the hydraulic unit according to the invention, taken like FIG. 2 with the shuttle in an end position.

The shuttle 7 is now in the end position P1, shown in FIG. 4, allowing the passage of the pressurized liquid from the first main circuit 2 to the intake of the motor 100, allowing the return of the low-pressure liquid to the second end portion 304, passing sequentially through the second chamber 16, the second port 24 and the fourth chamber 18.

In case of a stop, i.e., if the supply of the pressurized liquid to the first main circuit 2 is interrupted, the shuttle 7 tends to return to the intermediate position P0 under the action of the second spring 78, because in the third filling chamber 31 there no longer is liquid at a pressure that is high enough to contrast the axial action of the second spring 78.

Figure 3A:
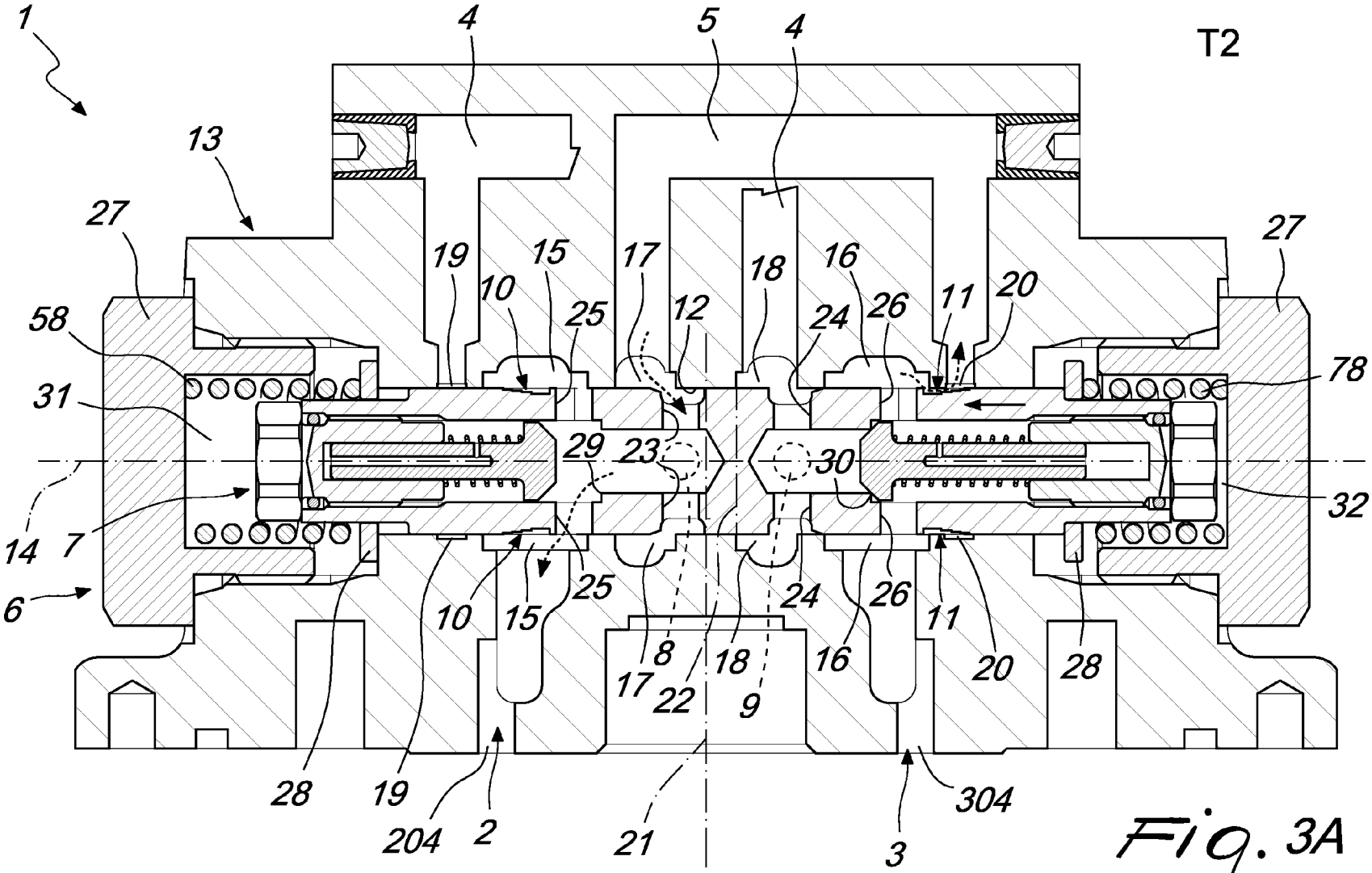
FIG. 3A is an axial sectional view of the hydraulic unit according to the invention, taken like FIG. 2, with the shuttle in a transient stopping position.

Although the motor 100 does not receive pressurized liquid by suction for its rotation, by inertia the motor 100 keeps on turning, acting as a pump, conveying pressurized liquid toward the second chamber 16. In the transient stop position T1, shown in FIG. 3A, in the second chamber 16 there is pressurized liquid brought from the second end portion 303. In the transient stop position T1, the chamber 16 is connected to the fourth chamber 18 through the second discharge channel 11, i.e., the second groove 73. Advantageously, the liquid thus passes to the second recirculation circuit 5 in order to return to the first initial portion 201 connected indirectly to the motor 100, passing sequentially through the third chamber 17, the first port 23, the first passage channel 8, the third port 25 and the first chamber 15.

During the stop transient T1, the shuttle 7 keeps on moving toward the intermediate position P0 of FIG. 2, consequently moving the second groove 73. The groove 73, by having a cross-section that decreases gradually proximate to the fourth chamber 18, during its movement reduces the passage section and consequently reduces the flow-rate of the liquid that can be transferred to the second recirculation channel 5, keeping its pressure constant. This allows a constant supply of liquid to the motor, which is still turning due to inertia, preventing the occurrence of the phenomenon of cavitation, and at the same time, stops gently the rotation of the motor.

The operation just described assuming for the first main circuit 2 supplied by the pressurized working liquid for the rotation of the motor 100 in one direction of rotation is valid, and with the same described effects, considering however that the shuttle 7 moves in the opposite direction, also if the second main circuit 3 is connected to the supply of pressurized working liquid for the rotation of the motor 100 in the direction of rotation that is opposite to the previous one, because of the evident symmetry of the hydraulic unit 1 illustrated in the accompanying figures. In this case, the counterbalancing valve 6 will pass to the end position P2, passing through the transient position T2.

In practice it has been found that the hydraulic actuation unit according to the invention fully achieves the intended aim, since by thanks to the presence of the damping means, it makes it possible to obtain a gradual flow of supply of the pressurized liquid to the motor during starting, thus avoiding kick-backs, in the opposite direction with respect to the driving direction, to the operator on the work vehicle with hydraulic drive.

Another advantage of the hydraulic unit according to the invention consists in that it allows a soft stopping of the motor, avoiding kick-backs in the direction of travel to the operator on the work vehicle with hydraulic drive, because the geometry of the recirculation circuits allows a gradual reduction of the flow-rate of the liquid to the motor.

A further advantage of the hydraulic unit according to the invention consists in that it operates with fast response times, because the elements used in the starting and stopping transient allow an instantaneous gradual discharge or inflow of the liquid, without requiring waiting for a cyclic opening and closing of valves or other hydraulic elements. Moreover, due to the absence of hydraulic valves that require opening and closure in the recirculation channels, the pressure variation that occurs inside the hydraulic unit during rotation of the motor by inertia is smaller than in the background art, because the recirculation flow, which avoids cavitation, is supplied to the motor with a decrease in flow-rate independently of the pressure that, with the motor in a step of decreasing rotation by inertia, tends to decrease automatically.

Another advantage of the hydraulic unit according to the invention resides in that it can operate independently without requiring external components or external control for actuating the counterbalancing valve, greatly reducing the space occupation dimensions.

A further advantage of the hydraulic unit according to the invention reside in that it is easy to provide and economically competitive with respect to the background art, because it requires the use of a smaller number of hydraulic components. This last point is reflected also in the higher reliability of the hydraulic unit, because a smaller number of hydraulic components ensures a higher reliability and a lower likelihood of failures.

Another advantage of the hydraulic unit according to the invention resides in that it can provide a solution that has a smaller space occupation than the background art, enabling to accommodate the unit in modest spaces.

The hydraulic actuation unit, particularly for controlling the starting and stopping of hydraulic motors, thus conceived is susceptible of numerous modifications and variations, all of which are within the scope of the appended claims.

All the details may furthermore be replaced with other technically equivalent elements.

In practice, the materials used, so long as they are compatible with the specific use, as well as the contingent shapes and dimensions, may be any according to requirements and to the state of the art.

The disclosures in European Patent Application No. 11425269.5 from which this application claims priority are incorporated herein by reference.

The invention claimed is:

1. A hydraulic actuation unit, for controlling the starting and stopping of hydraulic motors, comprising:

a first main circuit and a second main circuit, which are adapted to connect selectively a supply of pressurized working liquid and a tank to a hydraulic motor;

a first recirculation circuit and a second recirculation circuit for returning respectively a fraction of said working liquid from said second main circuit to said first main circuit and vice versa;

a counterbalancing valve, which comprises a shuttle that can switch to a first end position and a second end position, which correspond to the actuation of said motor with mutually opposite directions of rotation, and comprises a first passage channel and a second passage channel, which are arranged respectively along said first main circuit and along said second main circuit; said shuttle comprising a first check valve and a second check valve respectively arranged in said first passage channel and in said second passage channel, said first check valve comprising at least one first flow control element that can move from an open position, for the passage of said working liquid along said first passage channel and therefore along said first main circuit, to a closure position, for closing said first passage channel and therefore said first main circuit and vice versa, said second check valve comprising at least one second flow control element that can move from an open position, for the passage of said working liquid along said second passage channel and therefore along said second main circuit, to a closure position for the closure of said second passage channel and therefore of said second main circuit and vice versa;

a first discharge channel and a second discharge channel, for the connection respectively of said first main circuit to said second recirculation circuit, and of said second main circuit to said first recirculation circuit;

wherein said first check valve and said second check valve respectively are provided with first damping means and second damping means in order to slow down the passage movement respectively of said first flow control element and of said second flow control element from the respective closure position to the respective open position.

2. The hydraulic unit according to claim 1, wherein said first damping means comprise a first stem of said first flow control element which is associated hermetically so that it can slide within a first filling chamber provided in said first check valve for varying the inside volume of said first filling chamber by means of the passage of said first flow control element from said closure position to said open position and vice versa; said first stem having a first hole for the calibrated passage of said working liquid from said first filling chamber outward during the passage of said first flow control element from said closure position to said open position and for the calibrated passage of said working liquid toward said first filling chamber during the passage of said first flow control element from said open position to said closure position.

3. The hydraulic unit according to claim 2, wherein said counterbalancing valve has a third filling chamber connected to a first control portion of said first main circuit for the switching of said shuttle to said first end position and a fourth filling chamber which is connected to a second control portion of said second main circuit for the switching of said shuttle into said second end position.

4. The hydraulic unit according to claim 3, further comprising a first spring and a second spring, which contrast the action of said pressurized working liquid alternately in said fourth filling chamber or in said third filling chamber in order to return said shuttle to an intermediate position defined between said first end position and said second end position.

5. The hydraulic unit according to claim 1, wherein said second damping means comprise a second stem of said second flow control element which is associated slidingly and hermetically within a second filling chamber provided in said second check valve for varying the inside volume of said second filling chamber responsive to the passage of said second flow control element from said closure position to said open position and vice versa, said second stem having a second hole for the calibrated passage of said working liquid from said second filling chamber outward during the passage of said second flow control element from said closure position to said open position and for the calibrated passage of said working liquid toward said second filling chamber during the passage of said second flow control element from said open position to said closure position.

6. The hydraulic unit according to claim 1, wherein a first contrast spring and a second contrast spring act respectively on said first flow control element and on said second flow control element for the return of said first flow control element and of said second flow control element from the respective open position to the respective closure position.

7. The hydraulic unit according to claim 1, wherein said first discharge channel and said second discharge channel are extended circumferentially on the side wall of said shuttle.

8. The hydraulic unit according to claim 7, wherein said first discharge channel and said second discharge channel comprise, respectively, a first groove having a variable depth along an axial length of the first groove and a second groove having a variable depth along an axial length of the second groove, the first groove and the second groove being provided circumferentially on the side wall of said shuttle, said first groove being proximate to said first main circuit and to said second recirculation circuit and having a passage section for the working liquid that increases proximate to said first main circuit, said second groove being proximate to said second main circuit and to said first recirculation circuit and having a passage section for the working liquid that increases toward said second main circuit.

9. The hydraulic unit according to claim 1, further comprising a sliding seat for the hermetic sliding of said shuttle along a longitudinal axis of said sliding seat; said sliding seat having a first chamber, a second chamber, a third chamber, a fourth chamber, a fifth chamber and a sixth chamber, said fourth chamber and said fifth chamber being mutually connected through said first recirculation channel, said third chamber and said sixth chamber being connected to each other through said second recirculation channel.

10. The hydraulic unit according to claim 9, wherein said first main circuit and said second main circuit comprise respectively a first initial portion, which connects said third chamber and a supply of said pressurized working liquid or a tank, and a second initial portion, which connects said fourth chamber and a tank or a supply of said pressurized working liquid; said first main circuit comprising a first end portion, which connects said first chamber and an intake or discharge port of said motor, said second main circuit comprising a second end portion that connects said second chamber and a discharge or intake port of said motor.

11. The hydraulic unit according to claim 1, wherein said shuttle has a first port, a second port, a third port and a fourth port, said first port being connected to said third port through said first passage channel, said second port being connected to said fourth port through said second passage channel.

* * * * *